US006007015A

United States Patent [19]

Kinutani et al.

[11] Patent Number: 6,007,015

[45] Date of Patent: Dec. 28, 1999

[54] EDGEWISE WINDING SYSTEM FOR THIN, FLAT-TYPE CONDUCTOR WIRE

[75] Inventors: Kazuhiko Kinutani; Ryosuke Maruyama; Yoshihiro Nakano, all of Kadoma, Japan

[73] Assignee: Matsushita Electric Works, Ltd., Osaka, Japan

[21] Appl. No.: 08/924,731

[22] Filed: Sep. 5, 1997

[30] Foreign Application Priority Data

Sep. 17, 1996 [JP] Japan ..... 8-244675
Jan. 17, 1997 [JP] Japan ..... 9-006465

[51] Int. Cl.[6] ..... B65H 39/16; B65H 18/08; B21F 3/04

[52] U.S. Cl. ..... 242/441.4; 242/157 R; 242/447; 242/471; 29/605; 72/142

[58] Field of Search ..... 242/441.4, 441.2, 242/447, 447.1, 447.2, 447.3, 471, 157 R, 157.1; 29/605; 72/142, 144

[56] References Cited

U.S. PATENT DOCUMENTS

| | | | |
|---|---|---|---|
| 1,834,811 | 12/1931 | Vienneau | 242/471 X |
| 2,348,798 | 5/1944 | Franz | 242/471 |
| 3,140,968 | 7/1964 | Barrios et al. | 242/447.3 X |
| 3,141,806 | 7/1964 | Reinman | 242/471 X |
| 3,464,101 | 9/1969 | Zubal et al. | 72/142 |
| 3,729,968 | 5/1973 | Norris | 72/142 X |
| 3,793,864 | 2/1974 | Ferrentino | 242/441.2 X |
| 4,112,727 | 9/1978 | Brown | 72/142 |
| 4,617,725 | 10/1986 | Holter et al. | 242/447.3 X |

*Primary Examiner*—Michael R. Mansen
*Attorney, Agent, or Firm*—Lynn & Lynn

[57] ABSTRACT

An edgewise winding system for a thin, flat-type conductor wire is arranged for winding the wire edgewise on a winding shaft while supplying the wire onto the shaft preferably in a direction substantially along the axial line of the shaft. To this end, the system includes a winder having a support face out of which the winding shaft projects, and a wire erector having an engaging face engaged with the wire supplied edgewise on the shaft to urge the wire against the support face of the winder for preventing just wound portion of the wire from falling and a wire supply part for guiding the wire in the direction substantially along the axial line of the winding shaft.

5 Claims, 11 Drawing Sheets

EDGEWISE WINDING SYSTEM FOR THIN, FLAT-TYPE CONDUCTOR WIRE

BACKGROUND OF THE INVENTION

This invention relates to an edgewise winding system for a flat-type conductor wire and, in particular, to the edgewise winding system with respect to the flat-type conductor wire in an aspect of a thin web.

DESCRIPTION OF RELATED ART

Generally, in forming a coil with a round-type conductor wire, there occur gaps between respective winding turns, so that the space factor of the conductor wire will be low. In realizing a high space factor, therefore, coils formed with the flat-type wires have been often utilized.

In the case of the coil formed by the round-type wire, further, there arises a portion where a voltage difference between the winding turns becomes large, and it is required, for elevating the withstand voltage, to interpose a layer insulator paper or to provide a partition in coil bobbin for a sectional winding, whereby the space factor of the conductor is lowered. In the case of the coil of the flat-type wire, on the other hand, each winding turn contacts only with adjacent turns one turn before and after, and the portion where the voltage difference becomes large can be prevented from occurring.

In respect of the manner of winding the flat-type conductor wire, on the other hand, there are two ways, in one of which the longer side of rectangular section of the wire is rendered to be parallel with axial line of the coil, and in the other of which the longer side is made vertical to the axial line. The latter is referred to as an edgewise winding, which is featured in that an increment in the number of winding turns does not enlarge the coil in its diameter. The coils of this edgewise winding have been disclosed in Japanese Patent Publication No. 62-31809 and Patent Laid-Open Publication No. 4-75303.

The coil of such flat-type wire wound edgewise will be effectively applicable to a transformer of head lamp ignitor or the like.

In known arrangements for winding edgewise the flat-type wire, however, it has been required to provide a complicated groove or a special guide for exclusive use in winding shaft, so that there has been a problem that manufacturing device or jig is rendered to be complicated and costly.

SUMMARY OF THE INVENTION

An object of the present invention is, therefore, to provide an edgewise winding system for flat-type conductor wire which can realize the edgewise winding of such wire with a simple formation.

According to the present invention, the above object can be realized by an edgewise winding system for flat-type conductor wire in which the flat-type conductor wire is supplied onto a winding shaft and is wound edgewise on the shaft, characterized in that, typically, the flat-type conductor wire is supplied in a direction lying along the axial line of the winding shaft.

Other objects and advantages of the present invention shall be made clear in following description of the invention detailed with reference to respective embodiments shown in accompanying drawings.

Figure 1:
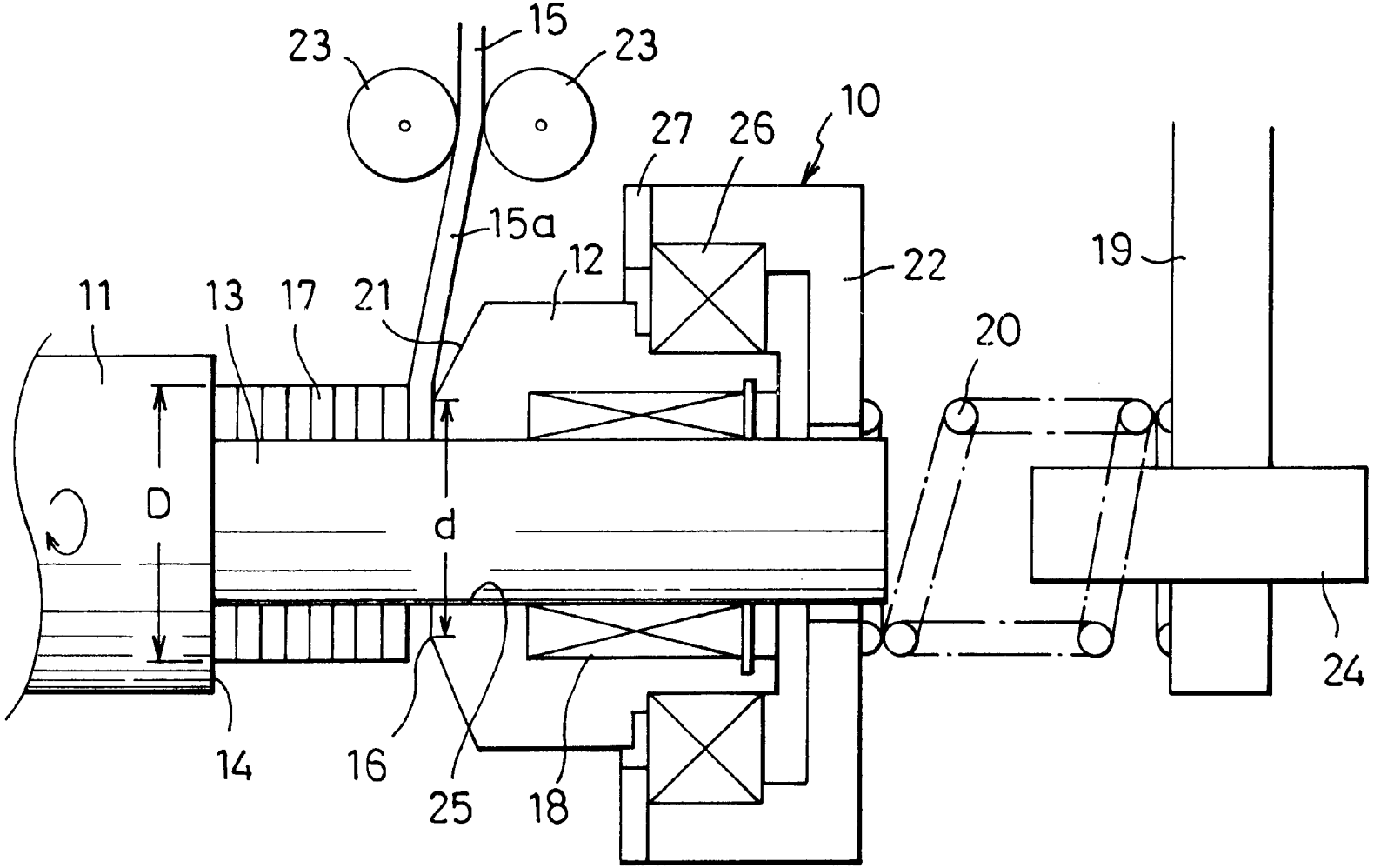
FIG. 1 is a schematic explanatory view for a basic formation of the edgewise winding system for the flat-type conductor wire according to the present invention.

While the present invention shall now be described in the followings with reference to the respective embodiments shown in the drawings, it should be appreciated that the intention is not to limit the invention only to these embodiments shown but rather to include all alterations, modifications and equivalent arrangements possible within the scope of appended claims.

DETAILED DESCRIPTION OF THE PREFERRED EMBODIMENTS

Referring to FIG. 1, there is shown a basic formation of the system according to the present invention, in which an edgewise winding device 10 for the flat-type conductor wire is provided with a winder 11 and a wire erector 12. The winder 11 projects a winding shaft 13 from a wire support face 14, and the winder 11 and winding shaft 13 are axially rotated by a rotating means, for which means such known means as a motor or the like (not shown) is employed.

The wire erector 12 is provided shiftably on the winding shaft 13 so as to prevent a thin, flat-type conductor wire 15 being wound on the shaft 13 from falling from its edgewise position by means of an engaging face 16, as being resiliently biased towards the support face 14. Here, the engaging face 16 of the wire erector 12 is formed to have a diameter d which is smaller than a diameter D of a coil 17 formed on the winding shaft 13 by the wire 15 wound thereon edgewise.

Further, the wire erector 12 shiftable on the winding shaft 13 is supported on the shaft through an axially slidable bearing 18. On a side of the wire erector 12 opposite to the engaging face 16, a spring supporter 19 is disposed to biase the erector 12 axially towards the support face 14 through a compression coil spring 20 interposed between the supporter 19 and the erector 12.

A guide face 21 is formed on outer periphery of the engaging face 16 for guiding a soon-wound portion 15a of the wire 15 onto the winding shaft 13. That is, the wire erector 12 is substantially of a columnar shape, the engaging face 16 is formed on a forward end face of which columnar shape to have a smaller diameter than the columnar shape, and the guide face 21 is provided as a slope of a partial conical shape between the engaging face 16 and an outer peripheral wall of the columnar erector 12. In addition, more specifically, the device 10 comprises a holder 22 for bearing and spring, a pair of pay-out rollers 23 for guiding the flat-type conductor wire 15 onto the winding shaft 13, a support projection 24 for the spring 20, an axial through hole 25 for passing the winding shaft 13, a rotary directional bearing 26 allowing the winding shaft 13 and the erector 12 to be rotated, and a setter 27 for setting the rotary directional bearing 26 in position.

According to the system for edgewise winding the flat-type wire with the foregoing winding device 10 employed, one flat face side at a starting end of the flat wire 15 is supported against the support face 14 of the winder 11 while the engaging face 16 is engaged against the other flat face side of the wire 15 to urge the wire against the support face 14, the winding shaft 13 is axially rotated to sequentially edgewise wind the wire 15 on the shaft 13, and the soon-wound portion 15*a* of the wire 15 is sequentially drawn between already wound portion of the wire 15 and the engaging face 16. The soon-wound portion 15*a* in this case is inclined onto the side of the wire erector 12 in the axial direction of the shaft 13 more than a plane of the engaging face 16, by means of the pay-out rollers 23 positioned on the side of the erector 12 with respect to the engaging face 16, so that the device is arranged for supplying the wire 15 from the side of the wire erector 12. With this arrangement, the wire 15 is caused to shift in smooth manner onto the winding shaft 13 along the engaging face 16 as guided through the guide face 21, so that the soon-wound portion 15*a* of the wire 15 can be prevented from riding on the already wound portion of the wire 15. When the pay-out rollers 23 or similar pay-out means is disposed on a traverse shaft (not shown), the positional relationship between the engaging face 16 of the wire erector 12 and the soon-wound portion 15*a* of the wire on the pay-out rollers 23 can be maintained constant, so that a more stabilized edgewise winding can be realized.

During this course of winding operation, both axial ends of the coil 17 formed as wound on the shaft 13 are held between the support face 14 of the winder 11 and the engaging face 16 of the wire erector 12, so that the edgewise winding can be reliably realized by means of such simple device or jig as in the above. Since the outer diameter of the engaging face 16 of the wire erector 12 is made smaller than that of the coil 17, the soon-wound portion 15*a* of the wire 15 before forming the coil 17 can be drawn in smooth manner between the engaging face 16 of the erector 12 and the end of the coil 17 as being prevented from riding on the already wound portion, the soon-wound portion 15*a* can be wound on the winding shaft 13 in smooth manner, and the flat wire winding work can be made easier. Accordingly, it is enabled to obtain the coil 17 of the edgewise wound flat wire at a low cost and of a high quality, without taking any special measure for overlapping prevention.

Further, as the guide face 21 is formed on outer periphery of the engaging face 16 for guiding the soon-wound portion 15*a* of the flat-type conductor wire 15, the soon-wound portion 15*a* of the wire 15 can be more reliably prevented from riding over the outer periphery of the already wound coil 17, by causing the portion drawn onto the winding shaft 13 as guided along the guide face 21.

Further, as the soon-wound portion 15*a* is inclined onto the side of the erector 12 in the axial direction of the shaft 13 beyond the engaging face 16, the portion 15*a* can prevented more reliably from riding on the already wound portion of the wire 15. When the soon-wound portion 15*a* is supported by a traverse shaft, it is made possible to maintain constant the positional relationship between the engaging face 16 of the erector 12 with the wire 15 and the soon-wound portion 15*a*, and a more stabilized edgewise winding can be realized. For the flat conductor wire 15, a metal foil or the like may be employed.

Figure 2:
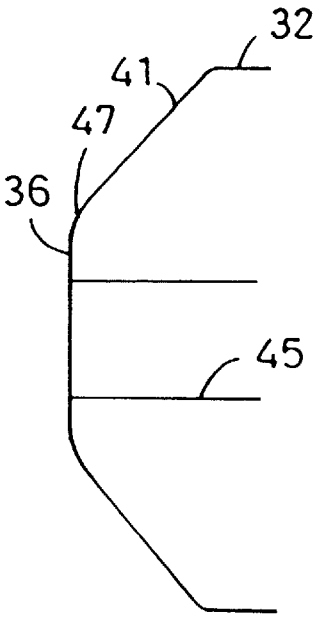
FIG. 2 is a fragmentary explanatory view for another aspect of part of the system according to the present invention.

In FIG. 2, another working aspect of the present invention is shown, in which the edgewise winding system for the flat wire is provided to be rounded at boundary line 47 between the engaging face 36 and the guide face 41 for smooth continuation, instead of rather sharp edge as in the case of FIG. 1. In the illustrated case, the boundary line 37 is formed to be of a curve R.

According to this aspect, the soon-wound portion 35*a* of the flat wire 35 is caused to easily slide from the guide face 41 through the rounded boundary 47 to the engaging face 36 and thus to be drawn in smooth manner.

Figure 4:
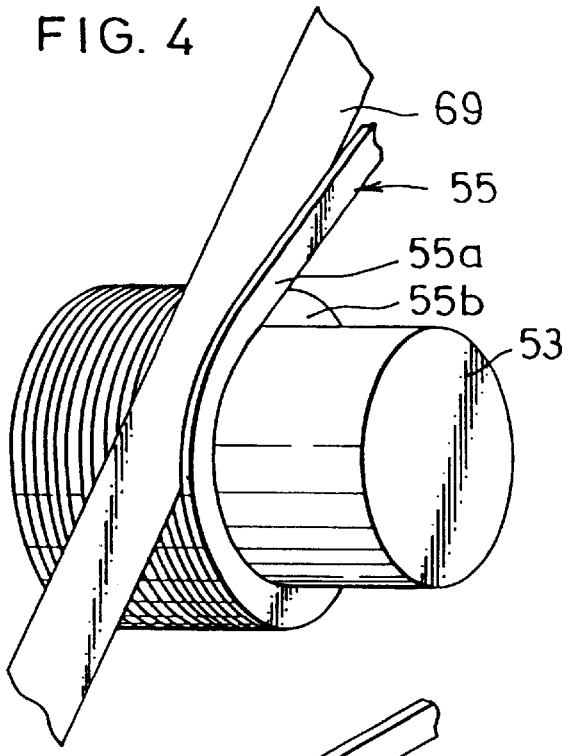
FIG. 4 is a fragmentary explanatory view for the operation in the aspect of FIG. 3 of the system according to the present invention.
Figure 3:
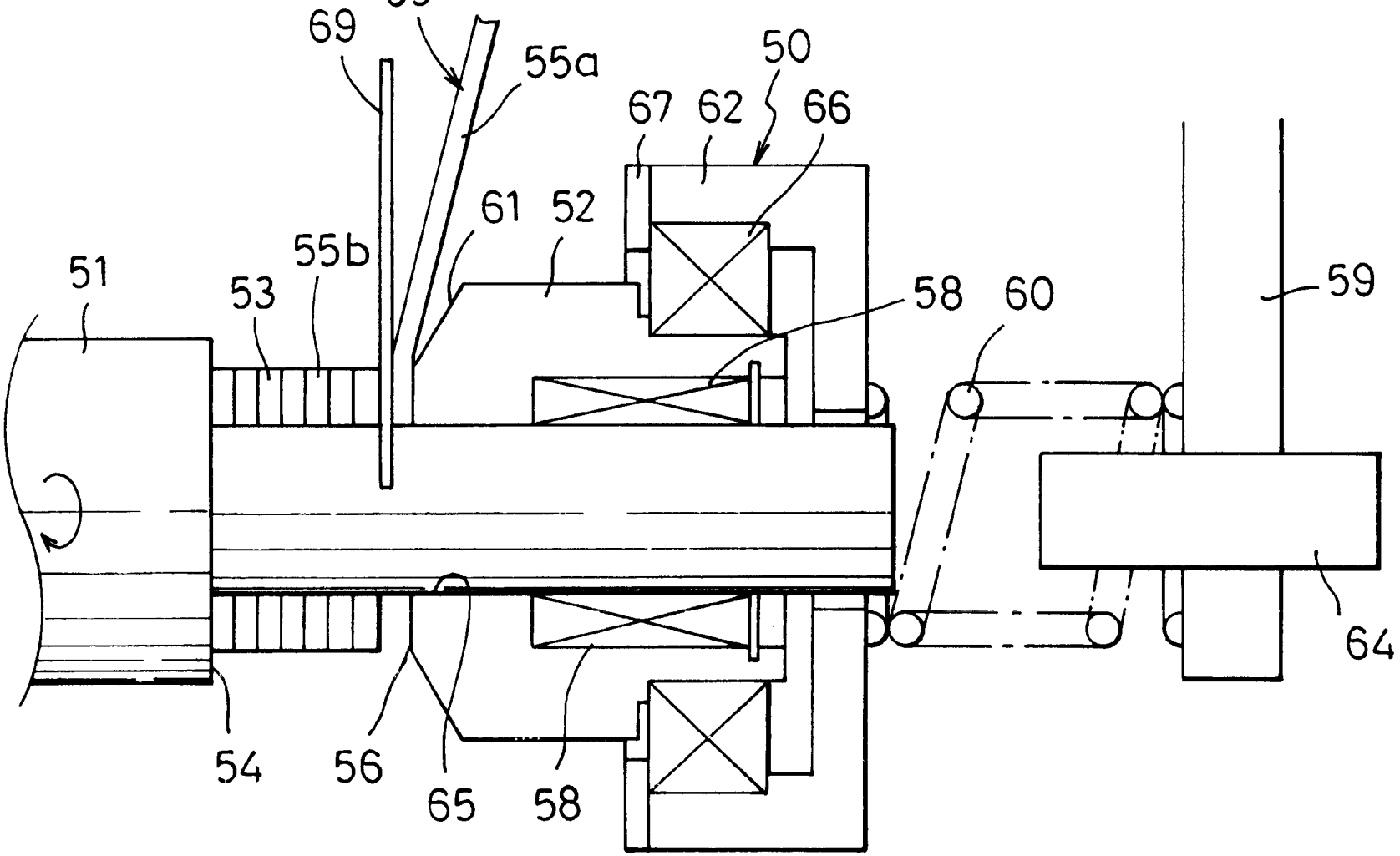
FIG. 3 is an explanatory view for another aspect of the system according to the present invention.

In an aspect as shown in FIGS. 3 and 4 of the system of the present invention, there is provided, in addition to the pay-out means (which may be such one as shown in FIG. 1) of the flat wire 55 and the winding shaft 53 of the winder 51 for winding thereon the wire 55 paid out of the pay-out means, a strip or bar member 69 for preventing the soon-wound portion 55*a* of the wire 55 from riding on the already wound portion 55*b* on the winding shaft 53.

With this edgewise wire winding system, the winding shaft 53 is rotated in one direction by the winding device, and the flat wire 55 paid out of the pay-out means is wound edgewise on the winding shaft 53, in which the winding can be performed while preventing, by means of the preventing member 69, the soon-wound portion 55*a* of the wire 55 from riding on the already wound portion 55*b* on the winding shaft 53.

In this case, too, similarly to the aspect of FIG. I, the flat wire 55 may be of any thickness in the thin web, the winding shaft 53 has the support face 54 for supporting the initial end of the wire 55 upon being rotated, the wire erector 52 has the axial through hole 65 for receiving the winding shaft 53, and the erector 52 is supported on the shaft 53 axially slidably by means of the axially slidable bearing 66 provided in the hole 65. As will be readily appreciated, such useful provisions as the guide face 61 for guiding the soon-wound portion 55*a* between the already wound portion 55*b* on the winding shaft 53 and the engaging face 56, and so on, may be employed. Here, FIG. 3 shows the same constituent members as those in FIG. 1 with the reference numbers used in FIG. 1 but added by 40, which members also perform the same function.

Referring more in detail to the riding prevention member 69, the same is provided in a thin strip shape, which is disposed only at a position close to the soon-wound portion 55*a* as interposed between the soon-wound portion 55*a* and the already wound portion 55*b* of the wire 55. With the positon of these wire portions 55*a* and 55*b* regarded as a criterion, the member 69 can be positioned for realizing a stable prevention of the riding. It will be preferable to use the riding prevention member 69 having a thickness in the axial direction of the winding shaft 53 substantially the same as that of the flat wire 55, so that the thickness of the member 69 can be determined in simple manner.

According to the aspect of FIGS. 3 and 4, the edgewise winding work is made easier, since the soon-wound portion 55*a* of the flat wire 55 can be effectively prevented from riding on the already wound portion 55*b* by means of the preventing member 69 when the flat wire 55 supplied from the pay-out means is wound on the winding shaft, and yet this can be established by such simpler jig as the riding preventing member 69 shown here. Since the preventing member 69 is provided only adjacent to the soon-wound portion 55*a*, the member 69 can be further simplified.

Instead of the foregoing thin strip shape of the riding preventing member 69, it is possible to employ various shapes of the member such as a thin plate, a rod and so on.

Figure 5:
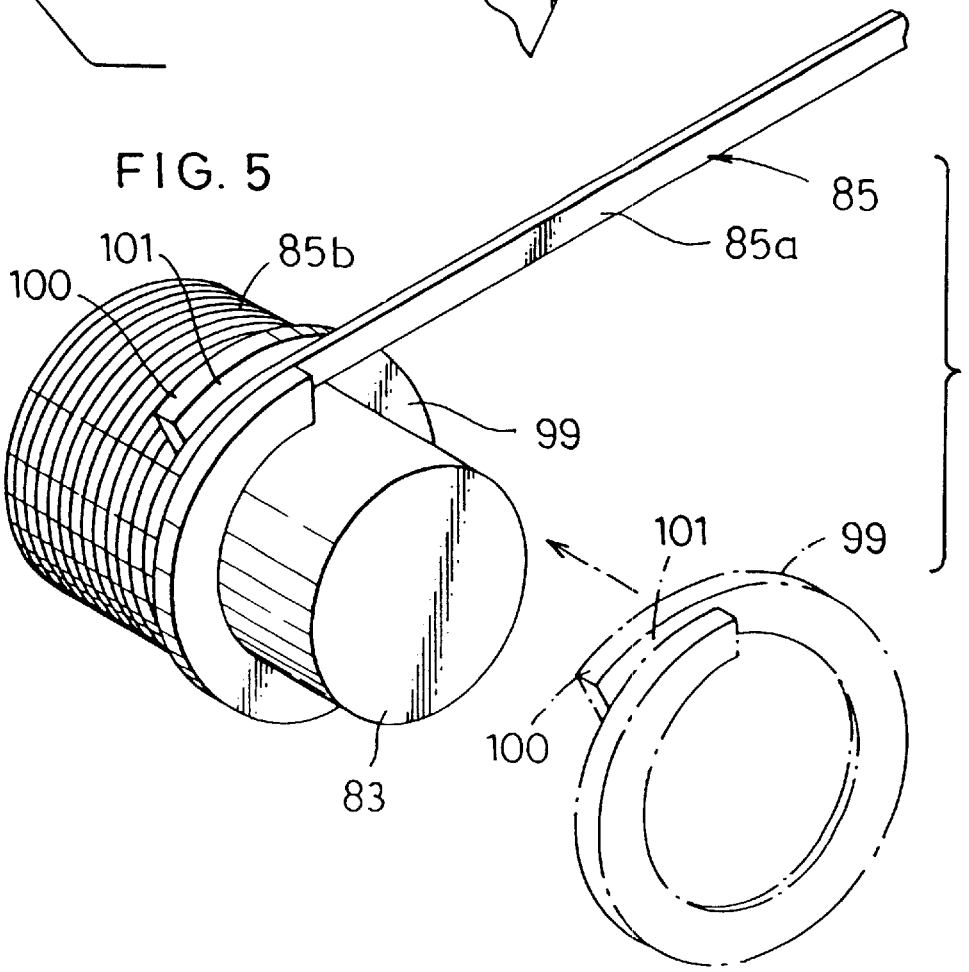
FIG. 5 is a similar fragmentary explanatory view to FIG. 4 for the operation but in another aspect of the system according to the present invention.

A different aspect from that of FIGS. 3 and 4 is shown in FIG. 5. In this case, the riding preventing member 99 in the edgewise winding device is formed in an annular shape to be externally fitted onto the winding shaft 83 in axially slidable manner and to define an interposing end 100 positioned between the soon-wound portion 85*a* and the already wound portion 85*b* of the flat wire. In practice, a similar flat wire of a rectangular cross section is bent annular into a one-turn coil shape, to have both end portions mutually overlapped in the axial direction while forming therebetween a gap 101 of a width allowing the soon-wound portion 85*a* to pass therethrough, and the interposing end 100 is thereby defined.

According to this aspect, this riding preventing member 99 is caused to slide in the axial direction as the wound coil of the already wound portion 85*b* increases its length in the axial direction, and it is made possible to actuate the member 99 without requiring any machine power.

Figure 6:
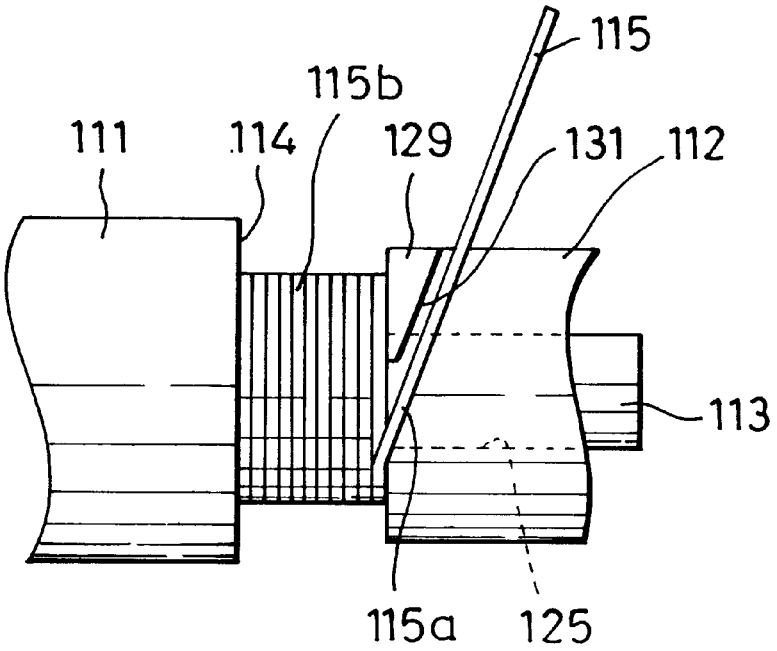
FIG. 6 is a fragmentary explanatory view for another aspect of part of the system according to the present invention.

In the edgewise winding device in another aspect of FIG. 6, the wire erector 112 provided axially slidably on the winding shaft 113 for urging the flat wire 115 wound on the shaft is formed to have, as the riding preventing member, an interposing member 129 integrally in a forward end portion of the erector 112. In this case, the wire erector 112 is formed in a cylindrical shape having the through hole 125 for slidably passing the winding shaft 113, and the interposing end 129 is formed by providing a groove 131 in the periphery at the forward end part. Further, while not shown, the spring for biasing the erector 112 on the winding shaft 113 towards the support face 114 of the winder 111 is provided.

According to this aspect, the provision of the groove 131 for guiding the flat wire 115 at a position corresponding to the soon-wound portion 115*a* of the wire 115 renders the soon-wound wire portion 115*a* to be guided in smooth manner, and the wire 115 can be effectively prevented from riding on the outer periphery of the already wound portion 115*b* by means of the interposing end 129.

Figure 7:
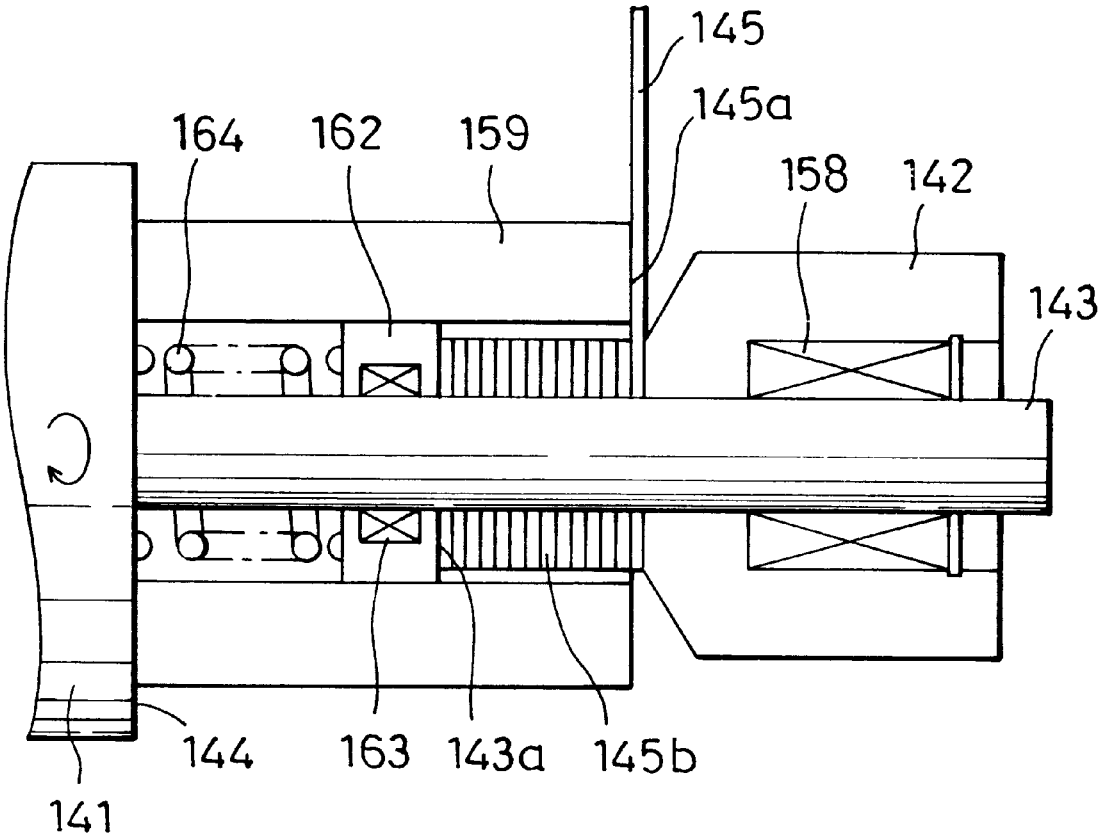
FIG. 7 is a schematic explanatory view for the system in another aspect according to the present invention.

In another aspect shown in FIG. 7, the edgewise wire winding device is constituted to have the riding preventing member 159 provided in a cylindrical shape to externally enclose the outer periphery of the already wound portion 145*b* as the coil on the winding shaft 143. In this case, the cylindrical member 159 is mounted to engage at one end with the support face 144 of the winder 141, a support ring 162 having a coil support face 143*a* is provided on the winding shaft 143 to be axially slidable with a shaft bearing 163 in a space between the shaft 143 and the cylindrical member 159, and a compression coil spring 164 is provided on the shaft 143 as interposed between the support face 144 and the support ring 162 for axially biasing the ring 162 against the starting end of the coil of the already wound portion 145*b* of the wire 145.

According to the above aspect of the invention, the soon-wound portion 145*a* is caused to be inserted between the other end of the member 159 and the wire erector 142 to be wound on the winding shaft 143 as the shaft 143 is rotated. So long as the axial shift of the wire erector 142 on the shaft 143 is blocked, the increment in the winding turns of the coil 145*b* causes the support ring 162 to shift away from the erector 142 along the winding shaft 143 while compressing the spring 164. As a result, the soon-wound portion 145*a* of the wire 145 is always positioned between mutually opposing end faces of the riding preventing member 159 and the erector 142, so that the member 159 can allow the soon-wound portion 145*a* of the flat wire 145 to be wound on the shaft 143 while preventing the portion 145*a* from riding on the outer periphery of the already wound portion 145*b*, and the same function and effect as those in the foregoing aspects can be attained.

As another aspect of the invention, it is also possible to provide the wire erector 142 movable rearward as the winding turn of the wire 145 increases, while causing the riding preventing member 159 to axially shift, following the movement of the erector 142.

Figure 8:
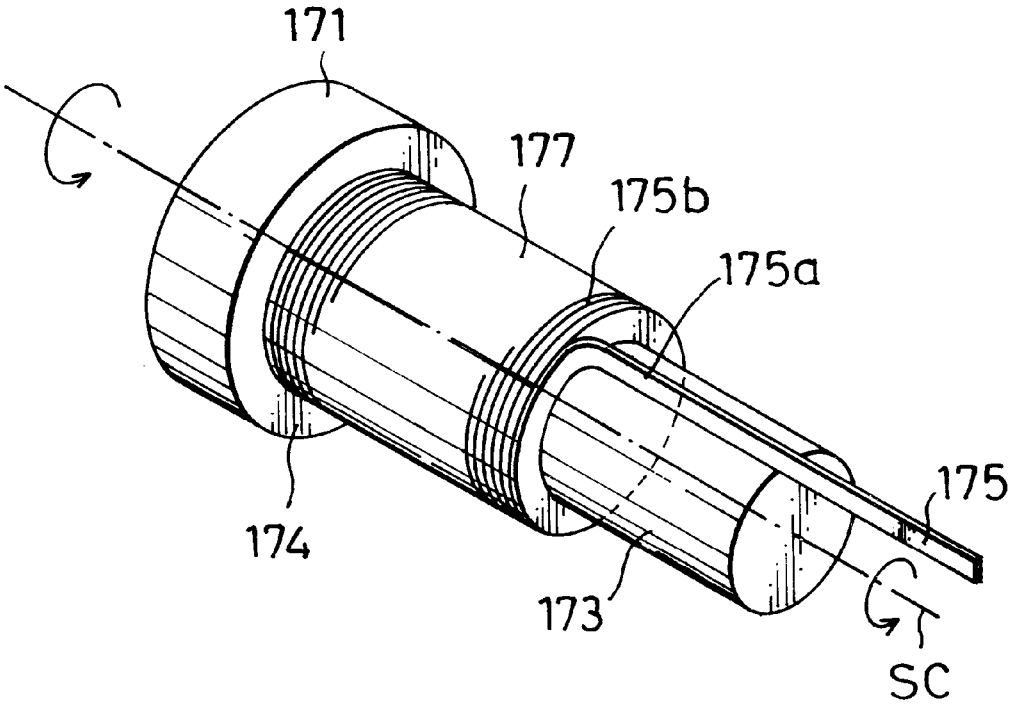
FIG. 8 is an explanatory perspective view of part of the system in a practical embodiment according to the present invention.
Figure 8A:
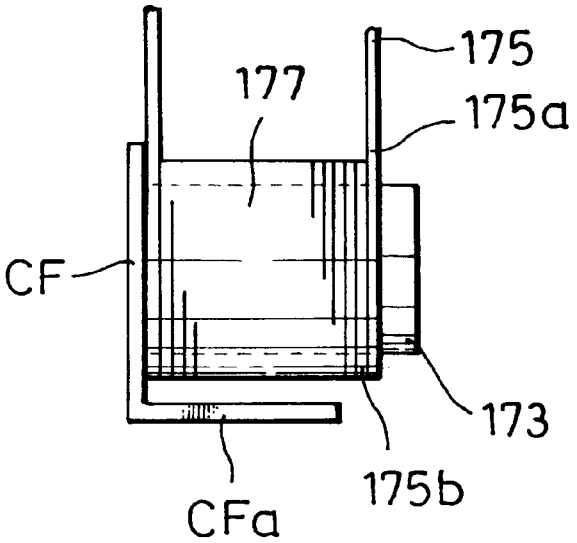
FIG. 8A is an explanatory view for an example of application of the embodiment of FIG. 8.
Figure 9:
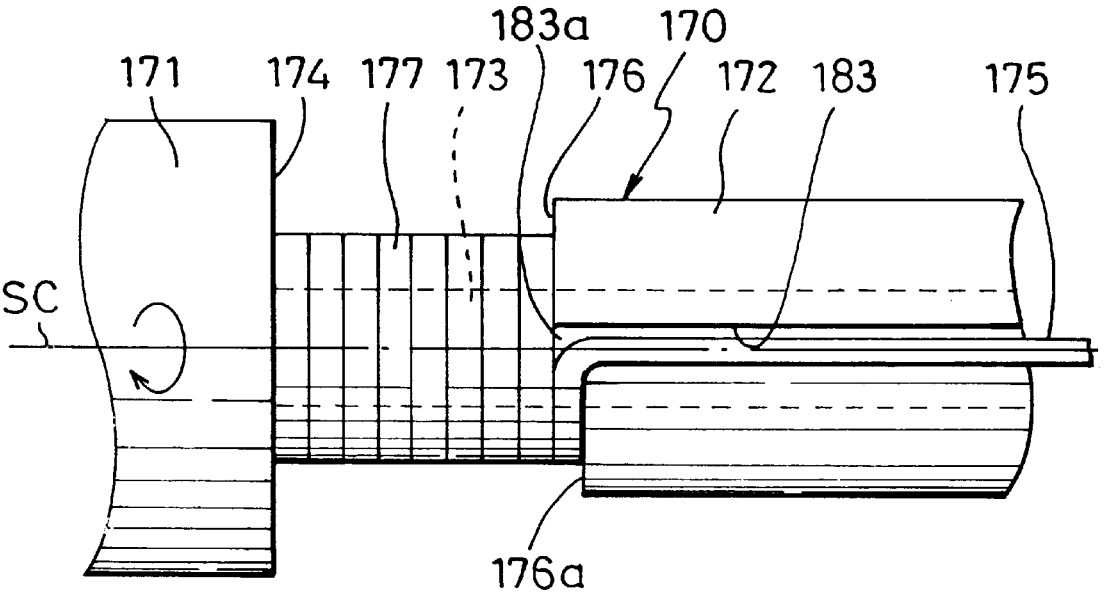
FIG. 9 is an explanatory view for the operation of the system in the embodiment of FIG. 8.

In FIGS. 8, 8A and 9, there is shown an embodiment embodying one of features of the present invention, according to the edgewise flat-wire winding system of which embodiment the flat wire 175 is wound on the winding shaft 173 as supplied onto the shaft 173 so as to have a supply direction of the wire 175 substantially aligned with the axial direction SC of the winding shaft 173, which shaft is axially rotated in a direction as shown in the drawings, for example, to wind up the flat wire 175 on the shaft 173 for forming the edgewise wound coil 177. The flat wire 175 is supplied from a remote position to a winding part for forming the edgewise wound coil 177, with the same flat wire 175 as the thin, flat conductor wire as in the foregoing aspects employed. The winding shaft 173 is projected out of the support face 174 of the winder 171 enough for optimumly supporting the edgewise wound coil 177.

It should be appreciated that, with this arrangement, a direct edgewise winding of the flat wire 175 into the coil 177 on a coil bobbin CF provided with an insulating member as in FIG. 8A, for example, is made possible.

That is, according to the edgewise winding arrangement for the flat conductor wire 175 of this embodiment, the supply of the wire 175 is performed substantially along the axial line of the winding shaft 173 in a direction from a position remote from the edgewise wound coil 177, so that the soon-wound portion 175*a* of the wire 175 can be reliably wound without riding on the outer periphery of the already wound portion 175*b*, and the wire 175 can be directly wound, instead of the winding shaft 173, on the bobbin provided with the insulating member as a measure for a high withstand voltage. Further, with the direct winding on the bobbin, such work as an incorporation into the bobbin of the edgewise wound coil 177 once wound on the winding shaft 173 of a separate device and removed from the shaft 173 is made unnecessary. Further, as the edgewise wound coil 177 is prevented from being loosened or unwound during the work of removing the coil from the winding shaft 173, it is possible to form the edgewise wound coil 177 made stable in the quality. Accordingly, it is made possible to wind the flat wire directly on the bobbin having an integral insulating part CFa extending in the axial direction on the outer periphery of the coil bobbin CF, so as to be able to reduce the number of required parts of the winding device and of assembling steps, and a cost reduction is made possible.

In FIG. 9, the edgewise winding arrangement of the embodiment of FIG. 8 is shown more concretely. That is, the edgewise winding device 170 for the flat wire 175 includes the winder 171 and the wire erector 172, while the winder 171 has the support face 174 and the winding shaft 173 projected out of the support face 174.

The wire erector 172 has the engaging face 176 for erecting and preventing the flat wire 175 on last wound side from falling, the wire 175 being wound with the other side facing the support face 174 of the winder 171 as initial wound side, as well as a flat wire supplying part 183 for guiding the wire 175 substantially along the axial line of the winding shaft 173. The wire erector 172 is fitted rotatably on the winding shaft 173. The wire supplying part 183 is formed as a groove substantially parallel to the axial direction of the winding shaft 173, an outlet 183*a* of this supplying part 183 on the side of winding direction is retracted in the axial direction by the shorter side or edgewise thickness of the flat wire 175, and a guide face 176*a* for the wire 175 as sloped gradually along the rotating direction of the shaft 173 and to continuously join with the engaging face 176. Since the flat wire 175 is spirally wound to be formed into an edgewise coil 177, by the way, the engaging face 176 of the erector 172 may not be provided with the sloped guide face 176*a* and may be formed as a flat plane vertical to the winding shaft 173, when the flat wire 175 is very thin.

Figure 10:
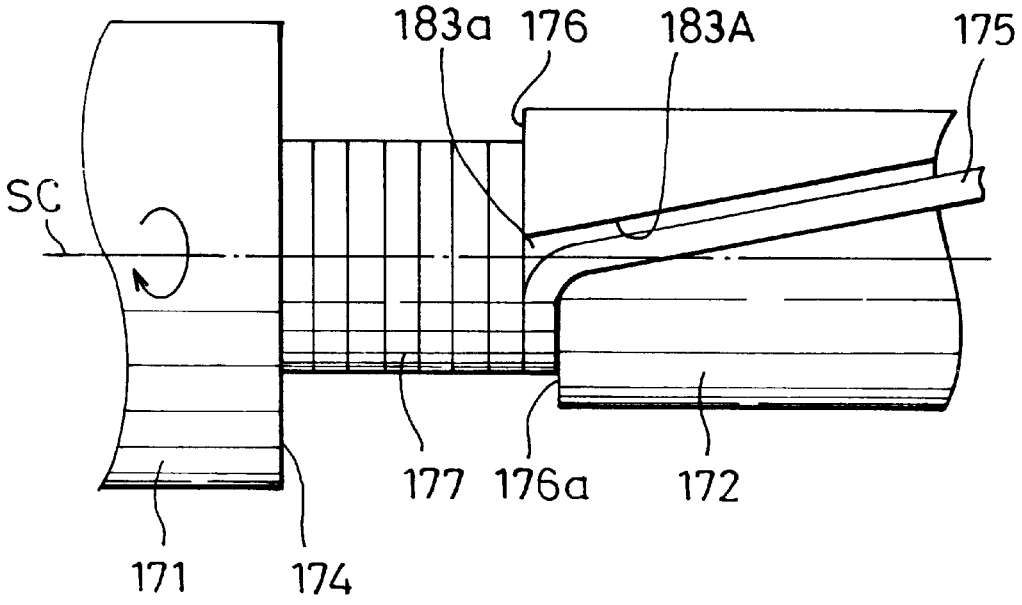
FIG. 10 is an explanatory view for the operation of the system in another working aspect according to the present invention.

In a working aspect of FIG. 10, the wire supplying part 183A is formed as a groove slightly inclined with respect to the axial line of the winding shaft 173, whereby the wire 175 can be supplied in a smooth manner in a direction substantially along the axial line SC of the winding shaft 173 while being prevented from falling.

According to the foregoing system of edgewise flat-wire winding, the flat wire 175 can be prevented from falling by the engaging face 176 of the wire erector 172 which engages the last wound side of the wire 175 on the winding shaft 173, and the edgewise wound coil 177 can be reliably formed without occurrence of any falling down of the wire 175 during the formation of the edgewise wound coil 177.

Further, with the substantially parallel disposition of the supplying direction of the flat wire 175 with respect to the axial line SC of the winding shaft 173, more stable edgewise winding can be realized, and even the flat wire 175 of different specification of dimensions from those of conventional wires is enabled to be wound by means of the same coil winding device 170, so that the system can even be made applicable to automated manufacturing line.

Figure 11:
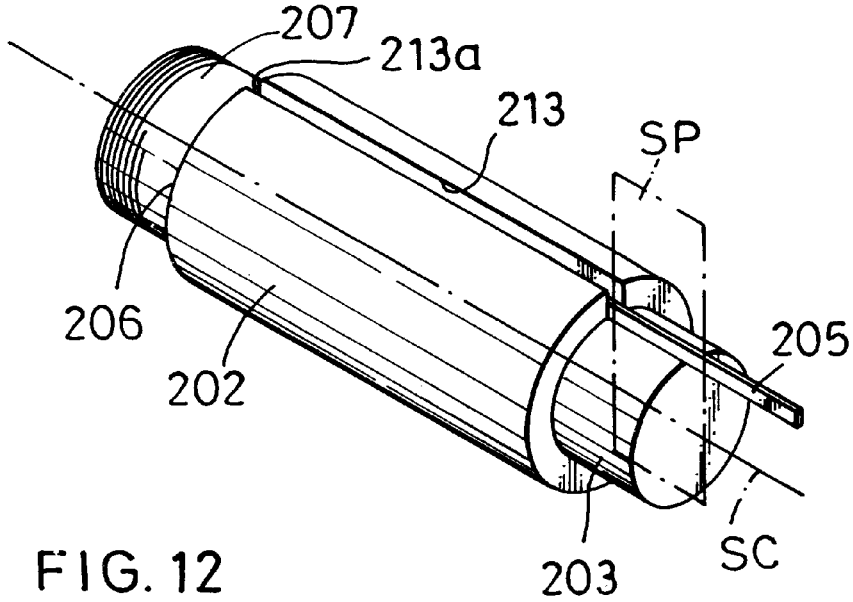
FIG. 11 is an explanatory perspective view of part of the system in another embodiment according to the present invention.
Figure 12:
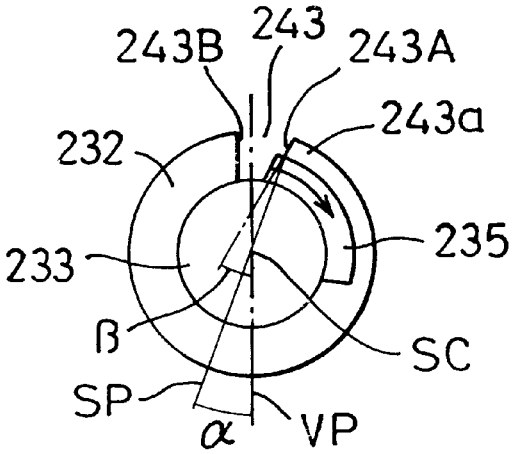
FIG. 12 is an explanatory endwise view of part of the system in another embodiment of the present invention.

In another embodiment of the present invention as shown in FIG. 11, the flat wire supplying part 213 in particular is formed as a groove lying substantially along a plane SP including the axial line SC of the winding shaft 203. The flat wire 205 can be guided through the groove-shaped wire supplying part 213 to the engaging face 206, and the edgewise coil 207 can be wound as the winding shaft 203 is rotated. At this time, the flat wire 205 is paid out in smooth manner from the outlet 213*a* of the wire supplying part 213 similarly to the foregoing embodiments.

According to this embodiment, the flat wire 205 can be supplied upon the winding without any difficulty and, as the manufacture and working of the wire erector 202 are easy, the costs can be reduced.

In another embodiment of FTG. 12, the flat wire supplying part 243 having both side faces 243A and 243B is formed to have a portion, adjacent to the outlet 243*a* of one side face 243A with which the wire 235 engages, expanded outward with respect to radial line from the axial line SC. That is, an angle β defined by the plane of the expanded side face 243A and a vertical plane VP passing the widthwise center of the supply part 243 and the axial line SC is made larger than an angle a defined by a plane SP passing the axial line SC and outer edge of the side face 243A and the vertical plane VP.

According to this embodiment, it is possible to prevent the flat wire 235 from being drawn between the erector 232 and the winding shaft 233, and to reduce any influence on the wire 235 of a forcible bending of the wire 235 at the outlet 243*a* of the wire supplying part 243, the bending being rendered to be of a smooth curve, and it is enabled to wind a high quality edgewise coil.

Figure 13:
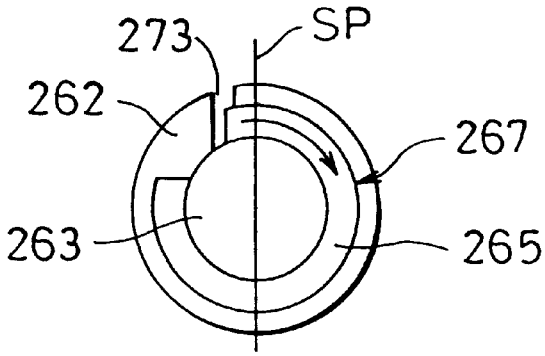
FIG. 13 is an explanatory endwise view of part of the system in another embodiment of the present invention.

In another embodiment of FIG. 13, the flat wire supplying part 273 is formed to be substantially parallel to the plane SP passing the axial line SC of the winding shaft 263 but disposed as deviated on a side opposite to the winding direction (shown by an arrow) of the wire 265, which wire is supplied through the wire supplying part 273 to the winding shaft 263 and is wound into the edgewise wound coil 267 with the winding shaft 263 rotated.

According to this embodiment, the flat wire 265 can be prevented from being drawn between the erector 262 and the shaft 263, and the erector 262 is formed to be easier for being worked, so that the costs can be reduced.

Figure 14:
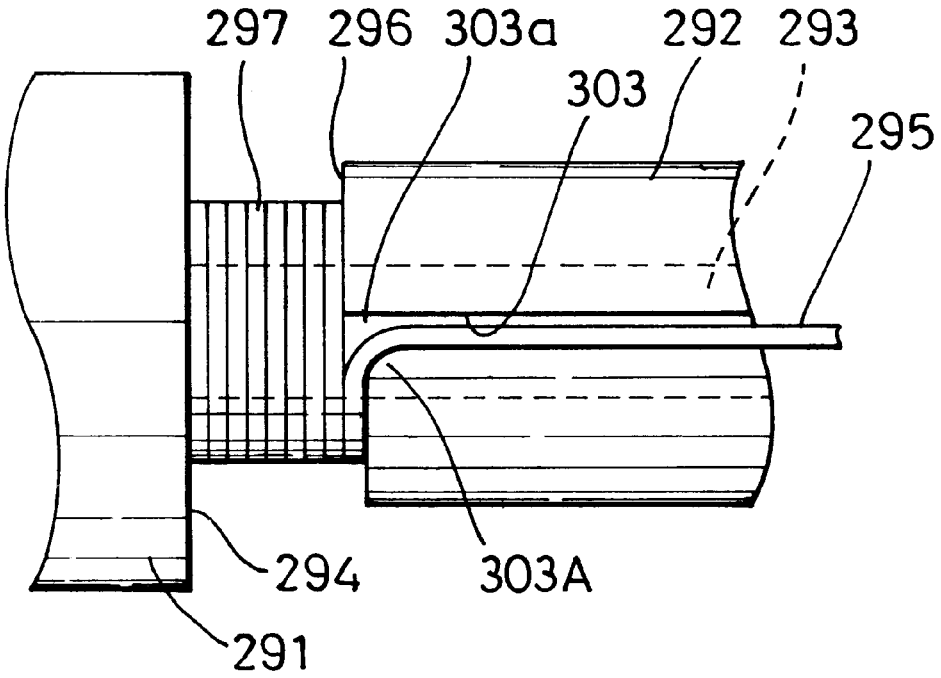
FIG. 14 is a fragmentary explanatory view of the system in another embodiment of the present invention.

In another embodiment shown in FIG. 14, a bending means 303A is provided at a corner edge in the winding direction of the flat wire 295 at the outlet 303*a* of the wire supplying part 303, for gradually turning the direction of the wire 295. In this case, the bending means 303A is formed with a curved surface of a predetermined radius of curvature, so that the flat wire 295 will be supplied as passed through this part to the winding shaft 293, whereby, as the winding shaft 293 is rotated, the flat wire 295 gradually turns its direction from the axial direction along the wire supplying part 303 to a circumferential direction lying along the periphery of the winding shaft 293 through the bending means 303A, and eventually can be wound on the winding shaft 293 in smooth manner.

According to this embodiment, the bending work of the flat wire 295 can be gradually performed, and a smooth supply of the flat wire 295 to the winding shaft 293 can be attained.

Figure 15:
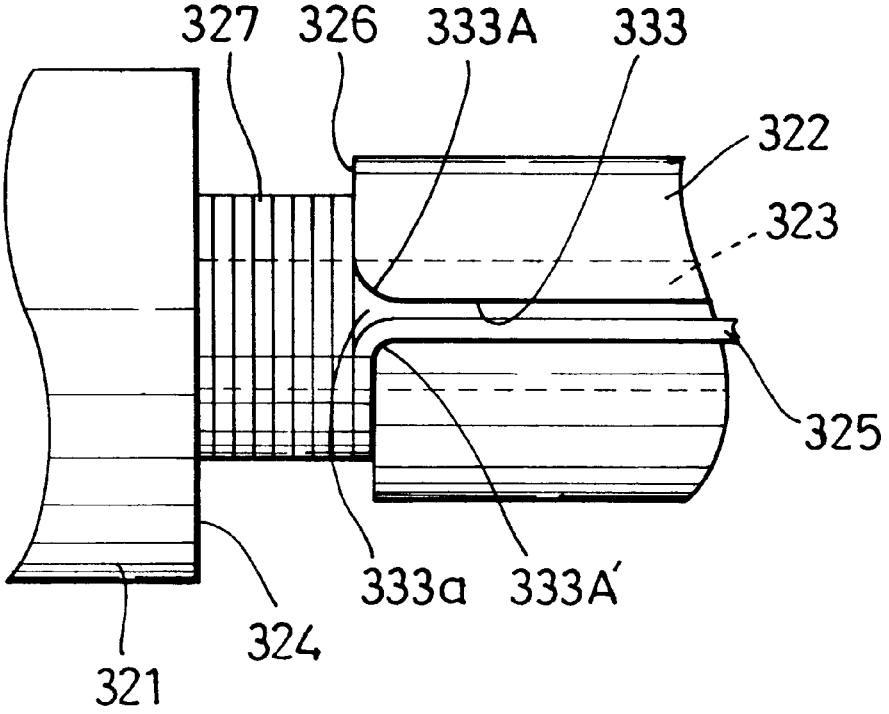
FIG. 15 is a fragmentary explanatory view of the system in another embodiment of the present invention.

In another embodiment shown in FIG. 15, two of the bending means 333A and 333A' respectively of the curved surface are formed at both side corner edges of the outlet 333*a*. According to this embodiment, it is possible to simply form the edgewise wound coil 327 in reverse direction only by changing the rotating direction of the winding shaft 323.

Figure 16:
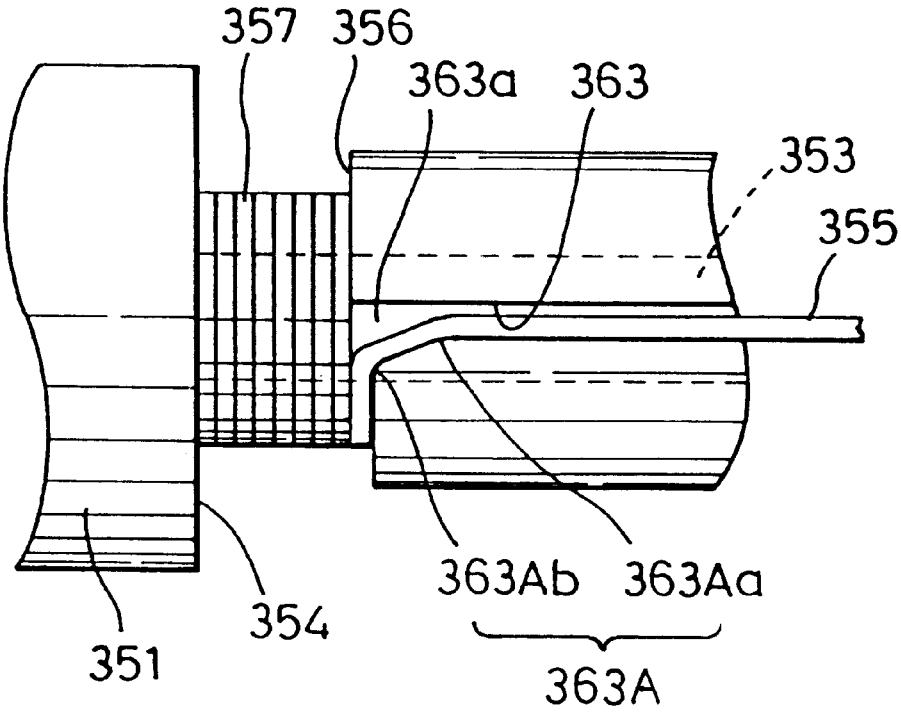
FIG. 16 is a fragmentary explanatory view of the system in another embodiment of the present invention.

In another embodiment shown in FIG. 16, the bending means 363A comprises a curved surface 363A*a* of a larger radius of curvature and a further curved surface 363A*b* of a smaller radius of curvature, which are provided for a smooth and sequential supply of the flat wire 355 from the curved surface 363A*a* to the curved surface 363A*b*. According to this embodiment, the supply of the flat wire 355 immediately before the winding is made more smooth.

Figure 17:
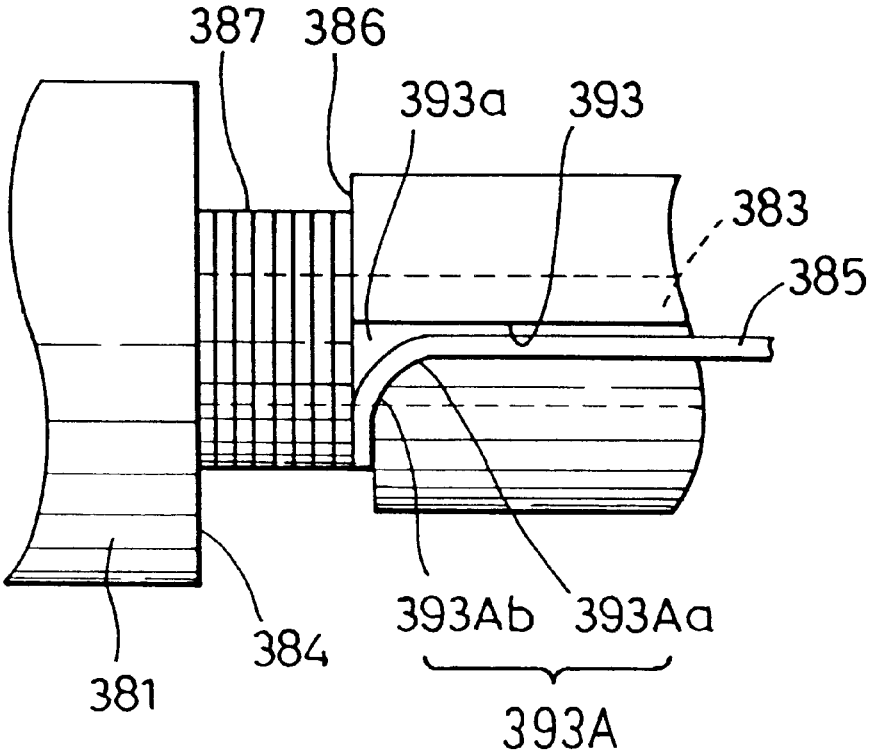
FIG. 17 is a fragmentary explanatory view of the system in another embodiment of the present invention.

In another embodiment shown in FIG. 17, the bending means 393A is provided for a smooth and sequential supply of the flat wire 385 from a curved surface 393A*a* of a smaller radius of curvature to a further curved surface 393A*b* of a larger radius of curvature, which surfaces extending from an inner face to the outlet of the wire supplying part 393. According to this embodiment, the winding up of the flat wire 385 to the winding shaft 383 is rendered more smooth.

Figure 18:
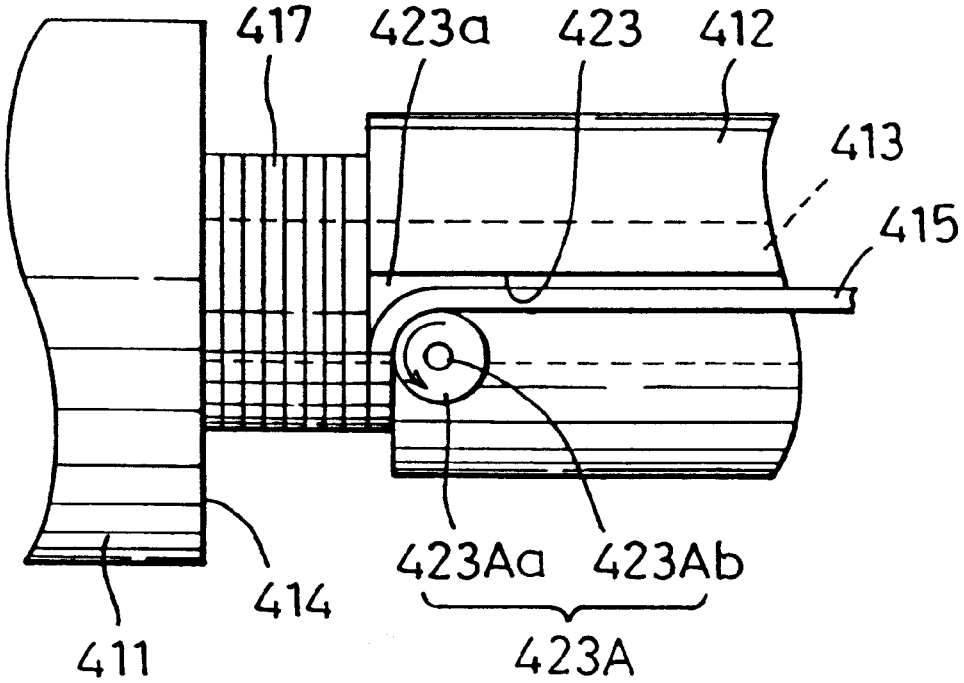
FIG. 18 is a fragmentary explanatory view of the system in another embodiment of the present invention.

In another embodiment shown in FIG. 18, the bending means 423A at the outlet 423*a* of the wire supplying part 423 is formed with a roller 423A*a* and a shaft 423A*b* for rotatably supporting the roller 423A*a* as mounted to the wire erector 412, so as to constitute the one side corner edge.

According to this embodiment, the edgewise wound coil 417 can be formed while performing gradually in smooth manner the bending upon turning the direction of the flat wire 415 along the engaging face of the erector 412, whereby a smoother supply of the flat wire 415 can be made, any frictional influence on the wire 415 can be reduced, and the edgewise wound coil of a high quality is enabled to be prepared.

Further, the bending means in the foregoing embodiments of FIGS. 16 to 18 may be provided at both side corner edges of the wire supplying part.

Figure 19:
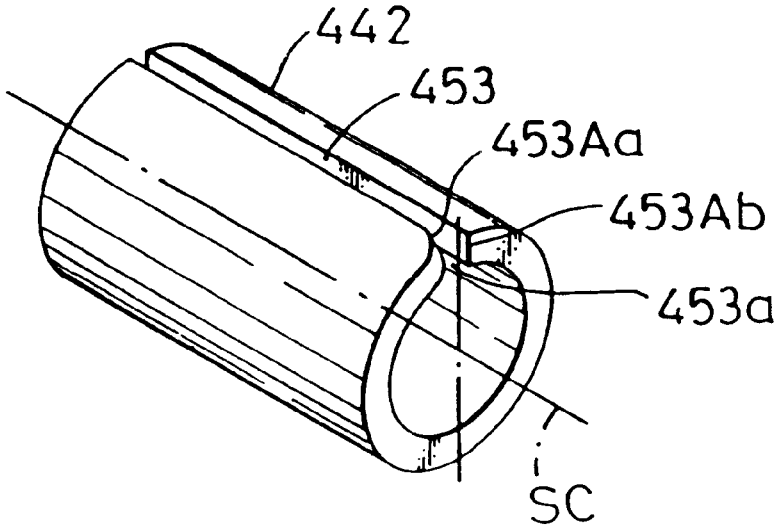
FIG. 19 is an explanatory perspective view of part of the system in another embodiment according to the present invention.

In another embodiment shown in FIG. 19, a combined formation of the embodiments shown in FIGS. 11 and 14 is adopted, in which the wire supplying part 453 having both side faces 453A*a* and 453A*b* is formed to be inclined with respect to the plane SP passing the axial line SC of the winding shaft and wire erector 442 and including the side face 453A*a* with which the wire 415 engages, so that a portion of the side face 453A*a* adjacent * to the outlet expands outward with respect to the radial direction of the axial line SC. The formation may render the wire erector 442 side to be rotated in forming the edgewise wound coil 417.

In the respective foregoing embodiments of FIGS. 5 to 19, the same or similar constituent members to those in preceding embodiment are denoted by the same reference numerals but as sequentially added by "30", and other members or formation than those which have been described are the same as those in the preceding embodiment, with the same functions made attainable.

Figure 20:
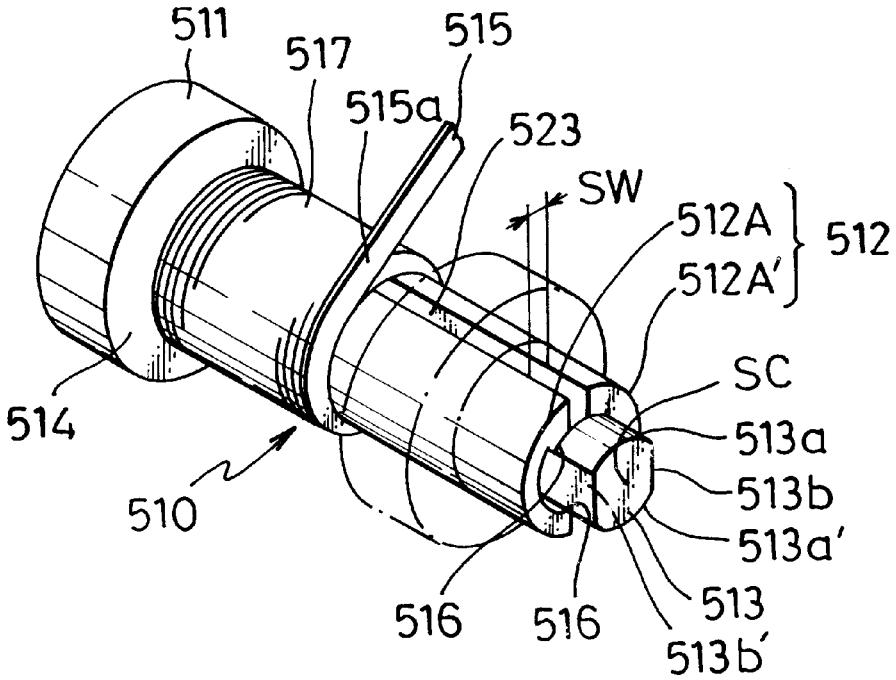
FIG. 20 is an explanatory perspective view for the system in another embodiment according to the present invention.
Figure 21:
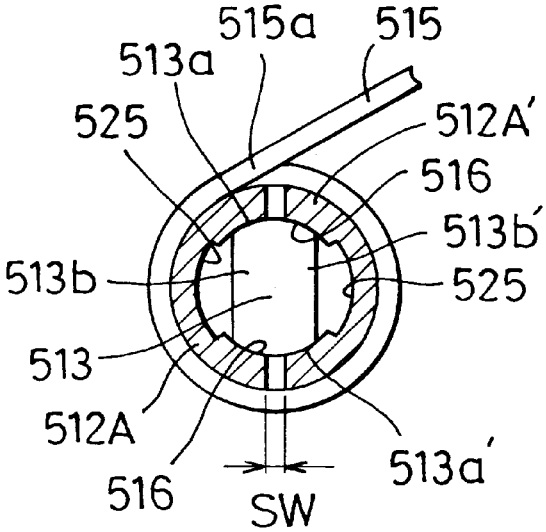
FIG. 21 is an explanatory sectioned view for winding operation of the system in the embodiment of FIG. 20.
Figure 22:
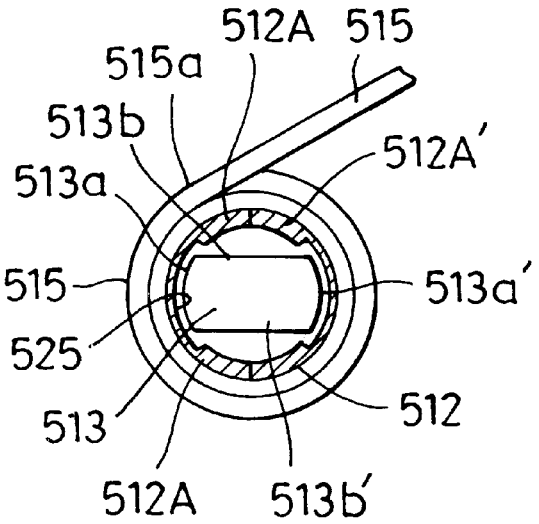
FIG. 22 is an explanatory sectioned view for wound coil detaching operation of the system in the embodiment of FIG. 20.

In FIGS. 20 to 22, there is shown a formation of the winding device embodying in particular a feature of the winding shaft, in the edgewise flat-wire winding system according to the present invention. That is, referring to FIGS. 20 to 22, the winder 511 in the winding device 510 of the edgewise winding system for the thin, flat-type wire comprises a winding shaft 513 and a winding erector 512. An end portion of the winding shaft 513 is formed substantially rectangular in section having thus longer diametered and shorter diametered portions in the circumference, forming a pair of longer diametered faces 513*a* and 513*a*' of a larger distance from the axial line SC and a pair of shorter diametered faces 513*b* and 513*b*' of a smaller distance from the axial line SC, the latter faces 513*b* and 513*b*' being formed to be parallel to the axial line SC and to each other.

The winding erector 512 is generally a hollow cylindrical member fitted on the winding shaft 513, the latter being relatively rotatable, and comprises specifically a plurality of splits 512A, 512A'. In the present embodiment, the member is divided into two splits 512A and 512A' respectively of a semicylindrical shape, and slit gaps 523 are defined between opposing edges in circumferential direction of both splits 512A and 512A' as fitted on the winding shaft 513. Further (as seen in FIG. 21) the winding erector 512 has, at the inner periphery of the splits 512A and 512A', bearing surfaces 516 to be in engagement with the pair of the longer diametered faces 513*a* and 513*a*' of the winding shaft 513, upon which the slit gaps 523 will be large in the gap SW. The slit gaps 523 of the winding erector 512 are positioned on the bearing surfaces 516 of the cylindrical splits 512A and 512A' forming the winding erector 512, and these splits 512A and 512A' are supported on outer periphery of the longer diametered faces 513*a* and 513*a*' of the winding shaft 513, so that the shape of the winding erector 512 can be effectively maintained. At this time, the outer periphery of the winding erector 512 will be a finishing inner diameter of the coil 517, while the bearing surface 516 has a shorter diametered inner face from the axial line of the shaft core than a later described fitting recesses 525 of the sheath.

Further the fitting recesses 525 are provided in the inner periphery of the splits 512A and 512A' of the winding erector 512 as recessed at positions remote in the circumferential direction from the bearing surfaces 516 (as seen in FIG. 22), so that, when the outer periphery of the longer diametered faces 513*a* and 513*a*' fit in these recesses 525, the slit gaps SW between the both side edges of the splits 512A and 512A' are made smaller. In this case, the fitting recesses 525 of the larger diameter than the bearing surfaces 516 are provided to mutually oppose, at positions rotated by about 90 degrees from the bearing surfaces 516. In the state where the outer periphery of the longer diametered faces 513*a* and 513*a*' of the winding shaft 513 are fitted in the recesses 525, the slit gaps SW are made zero, that is, the splits 512A and 512A' of the winding erector 512 are in the state of mutually fitted to support each other, and the shape of the winding erector 512 can be maintained. The fitting recesses 525 are defining an inner periphery of a longer diameter with respect to the axial line of the winding shaft 513 than the bearing surfaces 516.

Here, FIGS. 20 and 21 are showing the state in which the longer diametered faces 513*a* and 513*a*' of the winding shaft 513 are engaging with the bearing surfaces 516 of the winding erector 512, and the winding erector 512 is expanded in the diameter. In this state, the thin, flat-type conductor wire 515 is wound edgewise on the winding erector 512, to form the coil 517. That is, the flat wire 515 is supported at one end to the winder 511, and the wire 515 is sequentially wound on the winding erector 512, while disposing the thickness direction of the wire 515 aligned with the axial line SC of the winding shaft 513. During this winding operation, the longer diametered faces 513*a* and 513*a*' of the winding shaft 513 support the splits 512A and 512A' of the winding erector 512 to maintain the slit gaps SW, and also support the outer shape of the winding erector 512, while also functioning to hold the wire 515 during the winding.

On the other hand, FIG. 22 shows the state in which the winding shaft 513 is rotated by 90 degrees relative to the winding erector 512, so that the longer diametered faces

513*a* and 513*a*' can be fitted in the fitting recesses 525 inside the winding erector 512 so as to allow the winding erector 512 to be radially constricted. That is, after the edgewise winding of the flat wire 515 into the coil 517 with the winding erector 512 and winding shaft 513 kept in the state of FIGS. 20 and 21, the winding shaft 513 is relatively rotated by 90 degrees to fit the longer diametered faces 513*a* and 513*a*' of the winding shaft 513 in the recesses 525 of the winding erector 512, the splits 512A and 512A' of the winding erector 512 are engaged to each other to render their gaps SW to be zero, the winding erector 512 is made thereby to be constricted to have a smaller outer diameter than inner diameter of the coil 517, a gap is formed between the inner periphery of the coil 517 and the outer periphery of the winding erector 512, and the coil 517 is enabled to be easily detached from the winding erector 512.

According to this embodiment, the detaching of the coil 517 tightly wound on the winding erector 512 can be made easier by rendering the winding erector 512 to be constrictable with the winding shaft 513 rotated relative to the winding erector 512, the manufacturing work is simplified as the relative rotation of the winding shaft 513 can be very small. Since the structure is simplified, it is possible to manufacture the coil of a high quality at lower costs, and the winding system is enabled to be effectively employable for manufacturing coils of smaller diameter.

What is claimed is:

1. An edgewise winding system for thin, flat-type conductor wire, which system comprises:

rotating a winding shaft projected from a support face for an initial end of a coil to be formed on the winding shaft;

supplying the thin, flat-type conductor wire for the coil onto the winding shaft for an edgewise winding by leading the wire onto the shaft from a wire supply means to be substantially along the axial line of the winding shaft;

urging an engaging face of a wire erecting means against a part just supplied of the wire to bias the part just supplied towards the support face, the coil being formed on the winding shaft with the wire wound edgewise as supplied from the wire supply means positioned on the side of the wire erecting means with respect to the engaging face thereof;

proceeding with the winding of the wire on the winding shaft while supporting the initial end of the wire with the support face under a biasing force thereto of the engaging face of the wire erecting means urged towards the support face; and sequentially inserting a portion being soon-wound of the part just supplied of the wire between an already wound portion of the wire and the engaging face of the wire erecting means;

wherein, in supplying the wire onto the winding shaft, the wire is led through the wire supply means formed in a groove shaped to lie substantially along a plane passing the axial line.

2. The system according to claim 1 wherein the actuating of the engaging surface includes a step of guiding the soon-wound portion of the wire onto the winding shaft with a guiding means formed on outer peripheral side of the engaging face of the erecting means.

3. The system according to claim 1, wherein the wire supply means is substantially parallel to the winding shaft.

4. The system according to claim 1 wherein the groove-shaped wire supply means is formed to have a wire engaging side face formed at a portion adjacent to an outlet of the, wire supply means to be expanded outward in a radial direction from the axial line of the winding shaft with respect to a plane passing through the axial line and intersecting the wire engaging side face.

5. The system according to claim 1 wherein the groove-shaped wire supply means includes a bending means at a corner edge in winding direction of an outlet for gradually turning the direction of the wire.

* * * * *